US011819857B1

(12) United States Patent
Eisner et al.

(10) Patent No.: US 11,819,857 B1
(45) Date of Patent: Nov. 21, 2023

(54) APPARATUS AND METHOD FOR LIFTING A CRUSHING MANTLE OF A CONE OR GYRATORY CRUSHER AND CRUSHER COMPRISING SUCH AN APPARATUS FOR LIFTING

(71) Applicant: Kleemann GmbH, Göppingen (DE)

(72) Inventors: Alan Eisner, Mequon, WI (US); Lucas Scholz, Waldstetten (DE)

(73) Assignee: Kleemann GmbH

( * ) Notice: Subject to any disclaimer, the term of this patent is extended or adjusted under 35 U.S.C. 154(b) by 0 days.

(21) Appl. No.: 17/867,866

(22) Filed: Jul. 19, 2022

(51) Int. Cl.
*B02C 2/04* (2006.01)
*B02C 2/00* (2006.01)

(52) U.S. Cl.
CPC ..... *B02C 2/047* (2013.01); *B02C 2/005* (2013.01)

(58) Field of Classification Search
CPC ..... B02C 2/00; B02C 2/04; B02C 2/047; B02C 2/005; B23P 19/04; B23P 6/00; B66C 1/10; B66C 1/12; B66C 1/125; B66C 1/24; B66C 1/26; B66C 1/62; B66C 1/66; Y10T 29/49819; Y10T 29/49721
USPC ..... 29/428; 294/85, 86, 67.1, 67.22
See application file for complete search history.

(56) References Cited

U.S. PATENT DOCUMENTS

2013/0043697 A1* 2/2013 Holmes ..... B02C 2/005 241/285.2
2015/0290648 A1* 10/2015 Kuvaja ..... B66C 1/422 241/207

FOREIGN PATENT DOCUMENTS

| | | | |
|---|---|---|---|
| AU | 2015243563 | B2 | 10/2016 |
| DE | 1283654 | B1 | 11/1968 |
| WO | 2010086488 | A1 | 8/2010 |
| WO | 2011029133 | A1 | 3/2011 |

(Continued)

OTHER PUBLICATIONS

Co-pending related U.S. Appl. No. 17/867,849, filed Jul. 19, 2022 (not prior art).

*Primary Examiner* — Matthew Katcoff
*Assistant Examiner* — Mohammed S. Alawadi
(74) *Attorney, Agent, or Firm* — Lucian Wayne Beavers; Patterson Intellectual Property Law, PC

(57) ABSTRACT

An apparatus (2) for lifting a crushing mantle (4) of a cone or gyratory crusher is provided. The crushing mantle (4) has a first central axis (26) and an opening (10) with a clearance width (w) in its top region (12) surrounding the first central axis (26). The apparatus (2) comprises a plate-shaped lifting member (8) having a second central axis (18) and adapted to be attached to the top region (12) of the crushing mantle (4), wherein the first central axis (26) coincides with the second central axis (18) when the plate-shaped lifting member (8) is attached to the crushing mantle (4). The plate-shaped lifting member (8) includes at least one attachment member (32) adapted to be attached to a suspension assembly (36), in order to lift the plate-shaped lifting member (8) together with the crushing mantle (4) attached thereto. The plate-shaped lifting member (8) has a first dimension (d1) in a first direction being smaller than the clearance width (w) of the opening (10) in the top region (12) of the crushing mantle (4); and the plate-shaped lifting member (8) has a second dimension (d2) in a second direction being larger than the clearance width (w) of the opening (10) in the top region (12) of the crushing mantle (4). The first direction and the second direction run obliquely in respect to each other.

16 Claims, 10 Drawing Sheets

(56) References Cited

FOREIGN PATENT DOCUMENTS

| | | | | | |
|---|---|---|---|---|---|
| WO | 2012171778 | A2 | | 12/2012 | |
| WO | 2014064329 | A1 | | 5/2014 | |
| WO | 2015139897 | A1 | | 9/2015 | |
| WO | WO-2015139897 | A1 | * | 9/2015 | ..... B02C 2/005 |
| WO | 2015155205 | A1 | | 10/2015 | |
| WO | 2016169622 | A1 | | 10/2016 | |
| WO | 2020043891 | A1 | | 3/2020 | |
| WO | 2020073077 | A1 | | 4/2020 | |
| WO | WO-2022133516 | A1 | * | 6/2022 | |

* cited by examiner

APPARATUS AND METHOD FOR LIFTING A CRUSHING MANTLE OF A CONE OR GYRATORY CRUSHER AND CRUSHER COMPRISING SUCH AN APPARATUS FOR LIFTING

BACKGROUND OF THE DISCLOSURE

Field of the Disclosure

The present invention refers to an apparatus for lifting a crushing mantle of a cone or gyratory crusher having a first central axis and an opening with a clearance width in its top region surrounding the first central axis.

Further, the invention refers to a cone crusher or gyratory crusher for reducing the size of fed mineral material like stone, rock, concrete or the like, the crusher comprising a crushing mantle releasably attached to a carrier element rotatable about a working axis.

Description of the Prior Art

Cone or gyratory crushers are a compression type of machine that reduces the size of fed material by squeezing or compressing between a moving piece (crushing mantle or inner crushing blade) usually made of steel and a stationary piece (crushing ring or outer crushing blade) usually made of steel. The fed material is in particular a mineral material like stone, rock, concrete or the like. Hereinafter the invention will be discussed based on a cone crusher. However, it is understood that the explanations would correspondingly also apply to gyratory crushers.

A cone crusher will usually deliver a 4:1 to 6:1 reduction ratio, although other reduction ratios are available, too. As the closed side setting is set tighter to create a finer output, the volume or throughput capacity of the machine is also reduced.

The material fed into a cone crusher is crushed between a fixed crushing ring (in other words an outer crushing blade) of an upper part of the crusher's housing (or frame) and a crushing mantle (in other words an inner crushing blade), which rests on a conical seat near the bottom of a carrier cone (in other words a supporting cone or a cone head). The crushing mantle is attached to the carrier cone by an appropriate fastening device. Due to the very large forces that occur during the crushing process, the fastening device has to provide for a strong attachment of the crushing mantle to the carrier cone. At the same time the attachment should be torque proof, i.e. the crushing mantle is held from turning with respect to the carrier cone.

During operation of the cone crusher, the crushing mantle moves eccentrically in respect to the fixed crushing ring. The carrier cone is set into a tumbling or oscillating motion by a driving mechanism of the cone crusher. The dimensions of a crushing gap (or chamber) between the fixed crushing ring and the rotating crushing mantle in a certain point along the circumferential direction change continuously. In the crushing chamber, the material to be crushed is crushed by squeezing and compressing until it can leave the cone crusher as crushed material through the crushing gap. With other words, the carrier cone with the crushing mantle is entrained in an oscillating or gyrating motion about the working axis, wherein the crushing gap between the crushing mantle and the outer crushing ring varies at each point during the cycle.

The smallest crusher gap occurring during the cycle is called the closed side setting (CSS) of the cone crusher, and the difference between the maximum and the minimum of the gap is called the stroke of the crusher. By the crusher setting and the crusher stroke, as well as the operating speed of the crusher, it is possible, among other things, to influence the grain size distribution of the crushed material and the production capacity of the crusher.

The outer crushing ring as well as the inner crushing mantle are used as wearing parts during operation of the cone crusher and, therefore, have to be replaced from time to time. To this end, means have to be provided for lifting the crushing mantle from the carrier element after the fastening of the crushing mantle on the carrier element has been loosened. Various types of lifting devices are known in the state of the art.

For example, it is known from the prior art that the crushing mantle of a crusher on an external circumferential surface of the mantle has hooks for lifting casted into the crushing mantle. Since the hooks are located on the external surface or on the outside of the mantle and thus are in contact with the rather abrasive material to be crushed or already crushed during intended use of the crusher, i.e. the crushing process, the hooks are gradually worn down or abraded. Thus, the hooks cannot be used to remove a worn out crushing mantle from a carrier element of the crusher. Therefore, for disassembling typically lifting lugs are welded to the worn crushing mantle. However, this is an inconvenient and time-consuming process, which can also cause safety issues for the user, if the lifting lugs are not welded properly to the crushing mantle.

WO 2014/064 329 A1, WO 2015/139 897 A1 and WO 2016/169 622 A1 disclose a lifting device for lifting a crushing mantle or an outer crushing blade of a cone or gyratory crusher. The lifting device has three gripper arms, which extend radially, are equally spaced to each other in a circumferential direction and are articulated such that the clearance width of the gripper arms, i.e. the diameter of the gripper arms, can be increased and decreased. Initially, the gripper arms are retracted to reduce the diameter of the lifting device, so that the diameter is smaller than a clearance width of a circular opening provided in the top region or head of the crushing mantle. Then the gripper arms of the lifting device are inserted into an internal cavity of the crushing mantle through the opening and the gripper arms are extended in order to increase the diameter beyond the clearance width of the opening in the crushing mantle. The internal cavity is essentially cone-shaped with a smaller diameter at the top towards the opening and a larger diameter towards the bottom. So by extracting the gripper arms beyond the clearance width of the opening makes the distal ends of the gripper arms rest against internal cone-shaped walls of the cavity. The lifting device can then be lifted, e.g. by means of a suspension assembly, together with the crushing mantle. This allows removal of a worn out crushing mantle from the carrier element or the placement of a new or renewed crushing mantle onto the carrier element of the gyratory crusher. Finally, the gripper arms are retracted again and the lifting device is removed from the internal cavity. A disadvantage of these known lifting devices is the rather elaborate construction with many moving parts.

Further, WO 2020/043 891 A1 discloses a lifting device comprising a tightening strap which may be braced around an external circumferential surface of the crushing mantle thereby attaching the lifting device to the crushing mantle. When the lifting device is attached to the crushing mantle, it can be lifted together with the crushing mantle, e.g. by means of a suspension assembly, in order to place the crushing mantle on or remove it from the carrier element. A disadvantage of the known lifting device is the rather complicated and time consuming use of the lifting device. Furthermore, misoperation of the tightening strap, i.e. not tightening it properly, may lead to insufficient attachment of the lifting device to the crushing mantle resulting in a possible damage of the crushing mantle of the crusher and possible injuries to the users.

Finally, WO 2011/029 133 A1 discloses a lifting device in the form of a plug which may be selectively engaged and disengaged with the opening in the head of the crushing mantle by rotation in respective opposite directions about a central axis, thereby selectively attaching and detaching the lifting device to/from the crushing mantle. Thus, the lifting device is attached to the crushing mantle by means of a bayonet mechanism. When the lifting device is attached to the crushing mantle, it can be lifted together with the crushing mantle, e.g. by means of a suspension assembly, in order to place the crushing mantle on or remove it from a carrier element of the crusher. A disadvantage of the known lifting device is that rotation of the lifting device about the central axis for engagement with the crushing mantle is prone to misoperation by a user. If the lifting device is not properly engaged with the crushing mantle, the crushing mantle may come free during the lifting process and injuries to the user may occur. Furthermore, the known lifting device can only be safely used with crushing mantles which are not excessively worn out.

SUMMARY OF THE DISCLOSURE

Starting from the cited prior art, it is an object of the present invention to propose an alternative lifting apparatus and method for lifting a crushing mantle of a cone or gyratory crusher, which in particular can obliviate the drawbacks of the prior art.

In order to solve this object, starting from the apparatus of the above-identified kind, it is proposed that:

- the plate-shaped lifting member has a first dimension in a first direction being smaller than the clearance width of the opening in a top region of the crushing mantle; and
- the plate-shaped lifting member has a second dimension in a second direction being larger than the clearance width of the opening in the top region of the crushing mantle;
- wherein the first direction and the second direction run obliquely in respect to each other.

The apparatus comprises:

- a plate-shaped lifting member having a second central axis and adapted to be attached to a head region of the crushing mantle, wherein the first central axis coincides with the second central axis when the plate-shaped lifting member is attached to the crushing mantle;
- the plate-shaped lifting member comprising at least one attachment member adapted to be attached to a suspension assembly, in order to lift the plate-shaped lifting member together with the crushing mantle attached thereto.

The method for lifting a crushing mantle of a cone or gyratory crusher comprises the steps of:

- providing an apparatus of the above identified kind,
- attaching the plate-shaped lifting member to the head region of the crushing mantle, and
- lifting the plate-shaped lifting member together with the crushing mantle attached thereto.

With the plate-shaped lifting member having two different dimensions extending in two different directions running obliquely in respect to each other, preferably perpendicular to each other, it is possible to tilt or rotate the plate-shaped member, in a rotating direction, about a rotational axis extending essentially parallel to the first direction, in which the plate-shaped lifting member has the smaller dimension, and perpendicular to the second central axis of the plate-shaped lifting member. By doing so, in a view direction onto the plate-shaped lifting member parallel to the first central axis of the crushing mantle, the clearance width of the plate-shaped lifting member in the second direction is gradually reduced, starting from the larger dimension, until, at a given angle of rotation, the clearance width of the plate-shaped lifting member in the second direction is smaller than the clearance width of the opening provided in the top region of the crushing mantle. Now, in its orientation rotated about the given angle of rotation, the plate-shaped lifting member can be easily inserted through the opening in the top region of the crushing mantle into an internal cavity of the crushing mantle.

Then, the plate-shaped lifting member may be rotated, opposite to the rotating direction, about the rotational axis until, in the view direction parallel to the first central axis of the crushing mantle, the clearance width of the plate-shaped lifting member in the second direction is larger again than the clearance width of the opening in the top region of the crushing mantle. Thus, outer regions of the upper surface of the lifting member provided in the second direction come into contact from below with inner wall sections of the internal cavity of the crushing mantle, thereby attaching the plate-shaped lifting member to the wall sections of the internal cavity surrounding or delimiting the opening in the top region of the crushing mantle.

Finally, with the lifting member attached to the crushing mantle, the plate-shaped lifting member may be lifted in a direction parallel to the first axis of the crushing mantle, thereby also lifting the crushing mantle attached thereto. To this end, it is proposed that respective attachment members are provided or removably attached to the plate-shaped lifting member, preferably to a top surface of the lifting member. The attachment members may be in the form of hooks or eyelets or the like. The lifting member can be lifted, for instance, by attaching a suspension assembly to the attachment members. The suspension assembly may be in the form of a hoist, a crane, a hydraulic lifting device or the like.

By lifting the plate-shaped lifting member together with the crushing mantle temporarily attached thereto, a worn-out crushing mantle may be lifted from the carrier element of the crusher and/or a new or refurbished crushing mantle may be placed onto the carrier element of the crusher. In the case of a cone crusher, the carrier element is a carrier cone. In the case of a gyratory crusher, the carrier element has more of a hollow-cylindrical form. However, in both cases, the carrier elements have an essentially cone shaped top surface, on which the crushing mantle may be placed. Correspondingly, a bottom surface of the top or head of the crushing mantle facing towards the internal cavity, usually also has an essentially cone shaped form, no matter whether the crushing mantle is intended for use in a cone crusher ora gyratory crusher.

In an embodiment it is proposed that the plate-shaped lifting member is attached to a new or renewed crushing mantle as described above. Then, the crushing mantle is placed onto the respective carrier element of the crusher and mounted thereto. The insertion of the lifting element through the preferably circular opening in the head of the crushing mantle is only possible when there is enough free space in the internal cavity of the crushing mantle and the mantle head, respectively. For passing through the opening, the lifting member is oriented almost vertically—or at least in the given angle in respect to a top plane of the mantle head. Once the lifting member is positioned inside the internal cavity of the crushing mantle, it is oriented horizontally again, or almost parallel in respect to the top plane of the mantle head. In this situation, preferably, the first central axis of the crushing mantle and the second central axis of the plate-shaped lifting member are congruent or run essentially parallel to each other.

Then the attachment members, for instance in the form of lifting hooks or eyebolts, are mounted to a top surface of the lifting member. The crushing mantle is suspended on the attachment members and lifted into the crusher onto the carrier element. Once the crushing mantle sits on the carrier element, the attachment members might be removed and the plate-shaped lifting member is secured in the internal cavity. In particular, it is proposed that the lifting member is secured to the head of the crushing mantle or to the carrier element, respectively, where it remains until the crushing mantle is to be exchanged again, for instance because it is worn out from use. The crushing mantle sitting on the carrier element, may be fastened thereto by means of fastening means. They may comprise one or more screws. In particular, the fastening means may comprise a single central head bolt. The central head bolt or part of it may cover the lifting member during the intended use of the crusher, for protecting the lifting member from wear. Additionally, a protective cover might be attached to the fastening means or the head region of the mantle for providing additional wear resistance.

The apparatus as disclosed may have one or more of the following advantages:

- safe and convenient lifting of the crushing mantle for assembly and disassembly of the crushing mantle on the carrier element,
- the lifting member may stay inside the mantle head during operation (i.e. intended use) of the crusher and thus is definitely available when disassembly of the crushing mantle is required,
- no additional steps for attaching attachment members to worn out crushing mantle, in particular no welding to worn crushing mantle, are required, which significantly simplifies the removal of a worn out crushing mantle from the carrier element,
- no attachment of attachment members, in particular no casted in hooks or the like in the crushing mantle, are required, which significantly simplifies the mantle and reduces the value of a component worn out during operation of the crusher,
- the apparatus is simple, requires no pivoting part (like it is the case in WO 2014/064 329 A1), and no bayonet mechanism (like it is the case in WO 2011/029 133 A1).

According to one embodiment of the present invention, it is proposed that an outer section of a top surface of the plate-shaped lifting member constitutes a support surface, with which, during lifting the plate-shaped lifting member together with the crushing mantle attached thereto, the plate-shaped lifting member rests on an internal surface of the crushing mantle surrounding the opening in the crushing mantle. Preferably, the support surface is provided on that part or section of the top surface of the plate-shaped lifting member, where the plate-shaped lifting member has the second dimension. Of course, the plate-shaped lifting member may comprise more than one support surface, for instance two support surfaces opposite to each other in respect to the second central axis of the lifting member.

According to another embodiment of the invention, it is proposed that in a sectional view comprising the second central axis of the plate-shaped lifting member, the support surface has an inclination, resulting in a support surface having the form of one or more cone wedges. The advantage of this embodiment is that the support surfaces can rest with their full surface on a cone-shaped inner wall surface of the mantle head, the inner wall surface surrounding or delimiting the central opening formed in the upper or top region of the mantle head. To this end, it is proposed that the inclination of the support surface corresponds to an inclination of a cone shaped wall of the internal cavity of the crushing mantle.

According to yet another embodiment of the present invention, it is proposed that a top surface of the plate-shaped lifting member is provided with attachment means for removably attaching at least one attachment member. The attachment means may be designed, for instance, as one or more threaded holes or blind holes into which appropriate attachment members, for instance in the form of a hook or an eyelet, may be releasably attached, in particular screwed. The suspension assembly, for instance in the form of a hoist, a crane, a hydraulic lifting device or the like, may be releasably attached to the attachment member. By actuating the suspension assembly, the plate-shaped lifting member may be lifted together with the crushing mantle attached thereto.

It is conceivable that the attachment means and/or the attachment members limit a horizontal movement of the lifting member when in place for lifting the crushing mantle from the carrier element. This may limit a possible risk of the lifting member slipping through the opening provided in the top region of the crushing mantle while lifting the mantle. It is even imaginable that, in order to further improve safety, at least one wedge shaped attachment member could be used, which—lying on an outside surface of the crushing mantle surrounding the opening in the head region of the crushing mantel—clamps part of the head region surrounding the opening of the crushing mantle between the plate-shaped lifting member and the attachment member.

It is further proposed that the plate-shaped lifting member is provided with a central through hole surrounding the second central axis. This central through hole may be used for inserting part of fastening means, preferably in the form of a central fastening bolt, and for attaching it to the carrier element. In order to fasten the crushing mantle to the carrier element. The inserted part may be a threaded bolt of a central fastening bolt, which is screwed into a threaded hole provided in the head region of the carrier element. Additionally, a protective cover may be provided for further protecting the lifting member and/or the fastening means against wear.

Furthermore, securing means for releasably securing the plate-shaped lifting member to the carrier element may be provided in the apparatus. In particular, it is proposed that the securing means are provided in the plate-shaped lifting member. The securing means may be provided for securing the plate-shaped lifting member to the head of the carrier element or the carrier cone, respectively. The securing means may comprise one or more through holes through which securing screws may be guided and screwed into respective threaded holes provided in the head of the carrier element. By means of the securing means, the lifting member may be secured to the head of the carrier element after mounting of the crushing mantle to the carrier element and prior to the intended use of the crusher. After securing the lifting member to the head of the carrier element, a protective cover may be mounted to the crushing mantle, the lifting member and/or the carrier element.

The object of the present invention is also solved by a cone crusher or gyratory crusher for reducing the size of fed mineral material like stone, rock, concrete or the like, the crusher comprising a crushing mantle releasably attached to a carrier element rotatable about a working axis. In particular, it is proposed that the crusher further comprises an apparatus for lifting the crushing mantle of the crusher according to the present disclosure.

According to an embodiment, the crusher comprises a protective cover covering the plate-shaped lifting member once the crushing mantle has been placed on the carrier element. Furthermore, if at least one attachment member has previously been attached to the plate-shaped lifting member for lifting the lifting member together with the crushing mantle attached thereto by means of a suspension assembly, the fastening means for the crushing mantle mounted only after the at least one attachment member has been detached and removed from the plate-shaped lifting member.

Finally, the object of the present invention is also solved by a method for lifting a crushing mantle of a cone or gyratory crusher. In particular, the method comprises the steps of:

providing an apparatus according to the present invention, rotating, in a rotating direction, the plate-shaped lifting member about a rotational axis extending essentially parallel to the first direction and perpendicular to the second central axis of the plate-shaped lifting member until, in a view direction onto the plate-shaped lifting member parallel to the first central axis of the crushing mantle, the clearance width of the plate-shaped lifting member in the second direction is smaller than the clearance width of the opening in a top region of the crushing mantle;

inserting the plate-shaped lifting member through the opening in the top region of the crushing mantle into an internal cavity of the crushing mantle;

rotating, opposite to the rotating direction, the plate-shaped lifting member about the rotational axis until, in the view direction parallel to the first central axis of the crushing mantle, the clearance width of the plate-shaped lifting member in the second direction is larger again than the clearance width of the opening in the top region of the crushing mantle, thereby attaching the plate-shaped lifting member to a wall of the internal cavity of the crushing mantle; and lifting the plate-shaped lifting member in a direction parallel to the first axis of the crushing mantle, thereby also lifting the crushing mantle attached thereto.

According to an embodiment, the crushing mantle lifted by means of the plate-shaped lifting member is lifted from a carrier element of the cone crusher or gyratory crusher for removal therefrom or placed on the carrier element of the cone crusher or gyratory crusher for attachment thereto.

BRIEF DESCRIPTION OF THE DRAWINGS

Further advantages and embodiments of the present invention will become apparent by means of the accompanying figures and the following description. In this respect, it is emphasized that each of the features and characteristics shown in the figures may be important for the present invention on their own, even if not explicitly shown in the figures and/or not explicitly described in the following description. Furthermore, it is emphasized that the features and characteristics shown in the figures may be combined in any possible manner, even if not explicitly shown in the figures and/or not explicitly described in the following description. The figures show.

DETAILED DESCRIPTION

Figure 14:
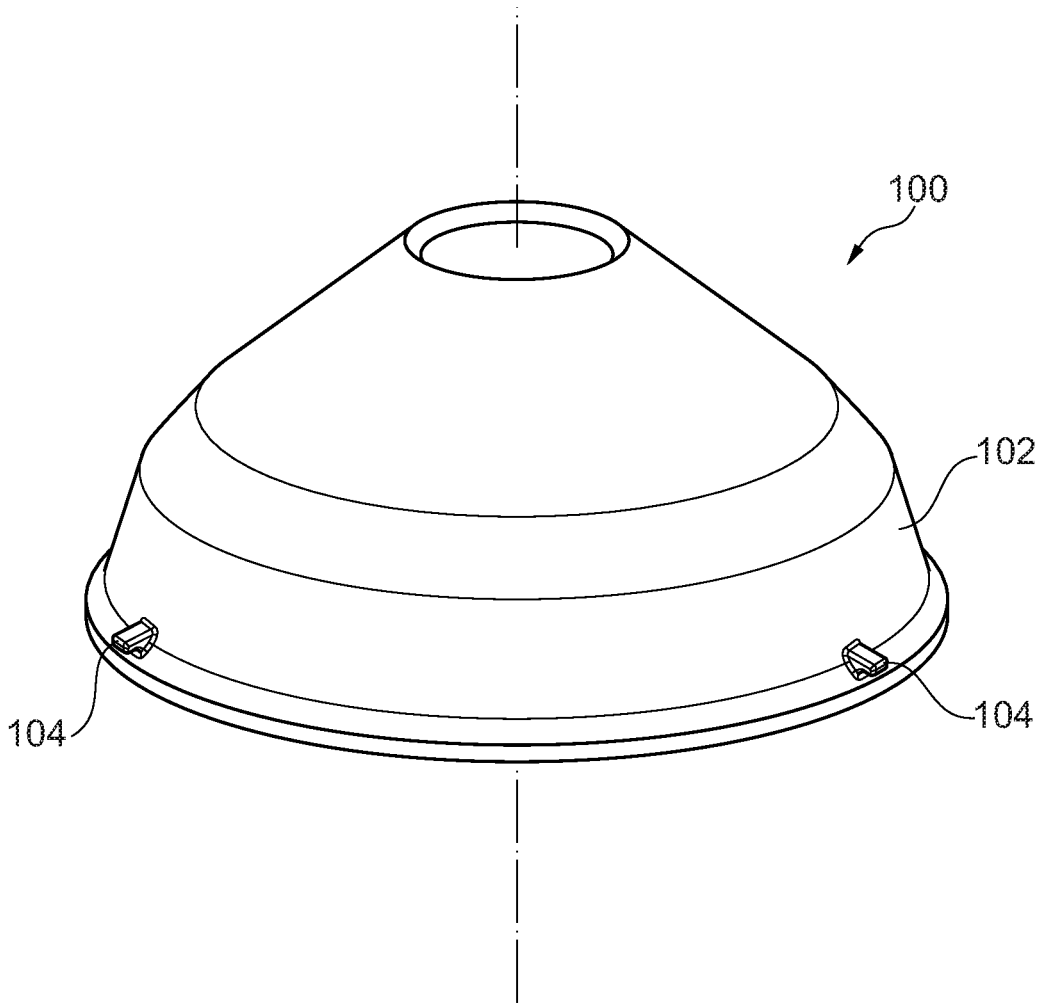
Fig. 14 Prior art
FIG. 14 a crushing mantle of a crusher with a known apparatus for lifting a crushing mantle of a cone or gyratory crusher.

FIG. 14 shows a crushing mantle 100 of a cone crusher or a gyratory crusher with a known apparatus for lifting the crushing mantle 100. It is known from the prior art that the crushing mantle 100 on an external circumferential surface 102 of the mantle 100 has hooks for lifting 104 casted into the crushing mantle 100. A suspension assembly, for instance in the form of hoist, a crane, a hydraulic lifting device or the like, may be releasably attached to the lifting hooks 104 in order to lift and lower the mantle 100.

Since the hooks 104 are located on the external surface 102 or on the outside of the mantle 100 and thus are in contact with the rather abrasive material to be crushed or already crushed during intended use of the crusher, i.e. during the operation of the crusher or the crushing process, the hooks 104 are gradually worn down or abraded. Thus, the hooks 104 cannot be used to remove a worn out crushing mantle 100 from a carrier element of the crusher. Therefore, for disassembling typically lifting lugs (not shown) are welded to the worn crushing mantle 100. However, this is an inconvenient and time-consuming process, which can also cause safety issues for the user, if the lifting lugs are not welded properly to the crushing mantle 100.

In contrast thereto, the present invention suggests a lifting apparatus 2 and a method for lifting a crushing mantle 4 of a cone or gyratory crusher, which can obliviate the drawbacks of the prior art. The design and functioning of a cone crusher is described in detail in prior art reference WO 2010/086 488 A1 (U.S. Pat. No. 8,944,356) which is incorporated herein by reference in its entirety. A gyratory crusher is designed and works accordingly. The crusher may be stationary or mobile. A mobile crusher is mounted onto a chassis provided with wheels, skids, chains or tracks in order to load the crusher on a transporter, to drive the crusher to its destined place of operation and to align it at its place of operation (see also FIG. 11).

Figure 1:
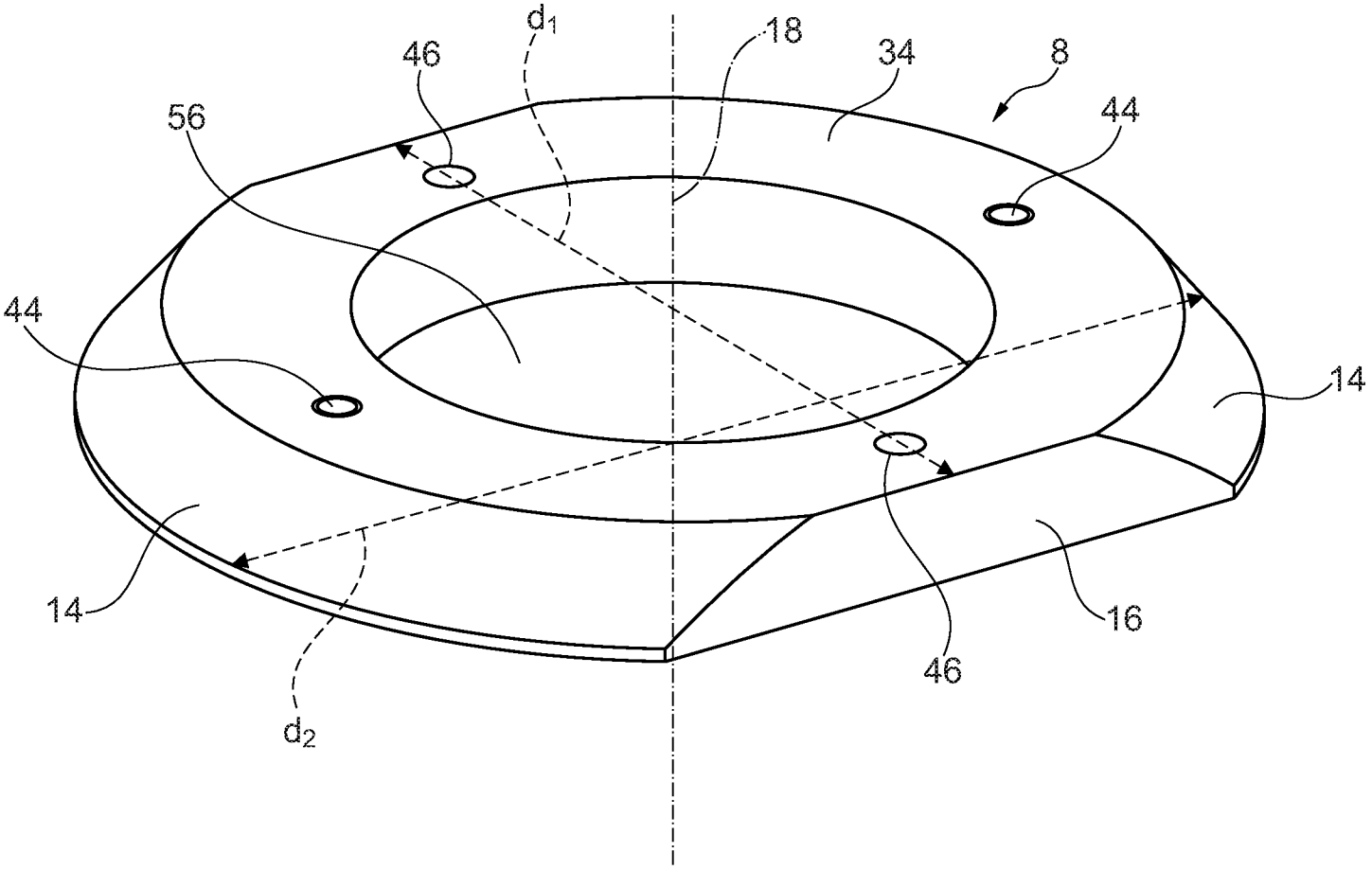
FIG. 1 a preferred embodiment of a plate-shaped lifting member of an apparatus according to the present invention in a perspective view.

In particular, it is proposed that the apparatus 2 comprises a plate-shaped lifting member 8, shown in detail in FIG. 1. The plate-shaped lifting member 8 has a first dimension d1 in a first direction being smaller than the clearance width w of a preferably circular opening 10 in a top region 12 of the crushing mantle 4. Further, the lifting member 8 has a second dimension d2 in a second direction being larger than the clearance width w of the opening 10 in the top region 12 of the crushing mantle 4. The first direction d1 and the second direction d2 run obliquely, preferably perpendicular in respect to each other.

The plate shaped lifting member 8 can be made of metal, in particular steel. It can have an essentially cone-shaped form with slanted circumferential support surfaces 14. The smaller dimension d1 in the first direction may be achieved by removing material of the initially plated- or ring-shaped element, e.g. by milling. The removed material leads to lateral surfaces 16, preferably extending vertically and parallel to a second central axis 18 of the lifting member 8. Preferably, the lateral surfaces 16 are provided on opposite sides of the plate-shaped lifting member 8 and with the same distance to the central axis 18. The distance between the lateral surfaces 16 forms the first dimension d1. The second dimension d2 is formed by the largest diameter of the plated- or ring-shaped lifting member 8, i.e. at the base of the cone. In the shown embodiment the support surfaces 14 have the form of cone wedges and are disposed on opposite sides of the lifting member 8. The support surfaces 14 interconnect the lateral surfaces 16 with each other.

Figure 2:
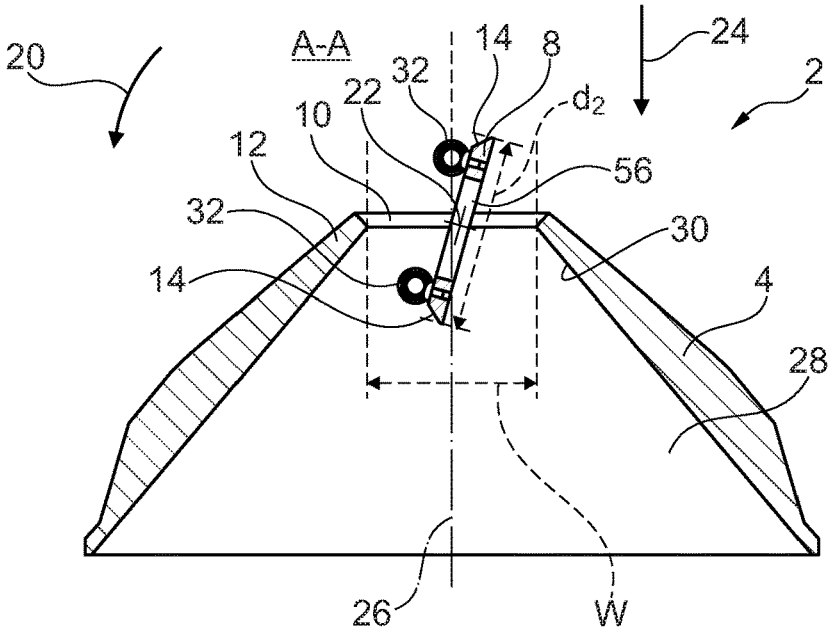
FIG. 2 the apparatus of FIG. 1 in a first orientation for insertion in a sectional view according to section A-A of FIG. 3.
Figure 3:
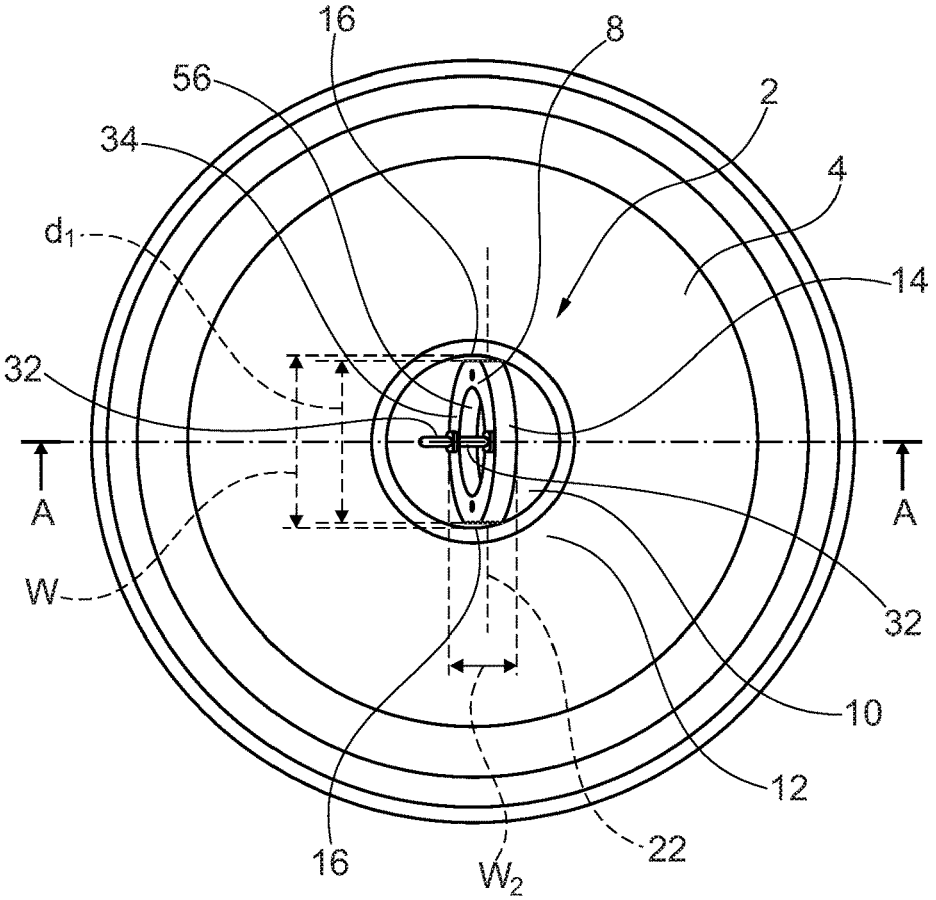
FIG. 3 the apparatus of FIG. 2 in a top view.

With the plate-shaped lifting member 8 having two different dimensions d1, d2 extending in two different directions running obliquely, preferably perpendicular in respect to each other, it is possible to tilt or rotate the plate-shaped member 8, in a rotating direction 20, about a rotational axis 22 extending essentially parallel to the first direction, in which the lifting member 8 has the smaller dimension d1, and perpendicular to the second central axis 18 of the lifting member 8 (see FIG. 2). By doing so, in a view direction 24 onto the plate-shaped lifting member 8 parallel to a first central axis 26 of the crushing mantle 4, the clearance width w2 of the plate-shaped lifting member 8 in the second direction is gradually reduced, starting from the larger dimension d2, until, at a given angle of rotation, the clearance width w2 of the lifting member 8 in the second direction is smaller than the clearance width w of the opening 10 provided in the top region 12 of the crushing mantle 4 (see FIG. 3). Now, in its orientation rotated at the given angle of rotation about the rotational axis 22, the plate-shaped lifting member 8 can be easily inserted through the opening 10 in the top region 12 of the crushing mantle 4 into an internal cavity 28 of the crushing mantle 4.

Figure 4:
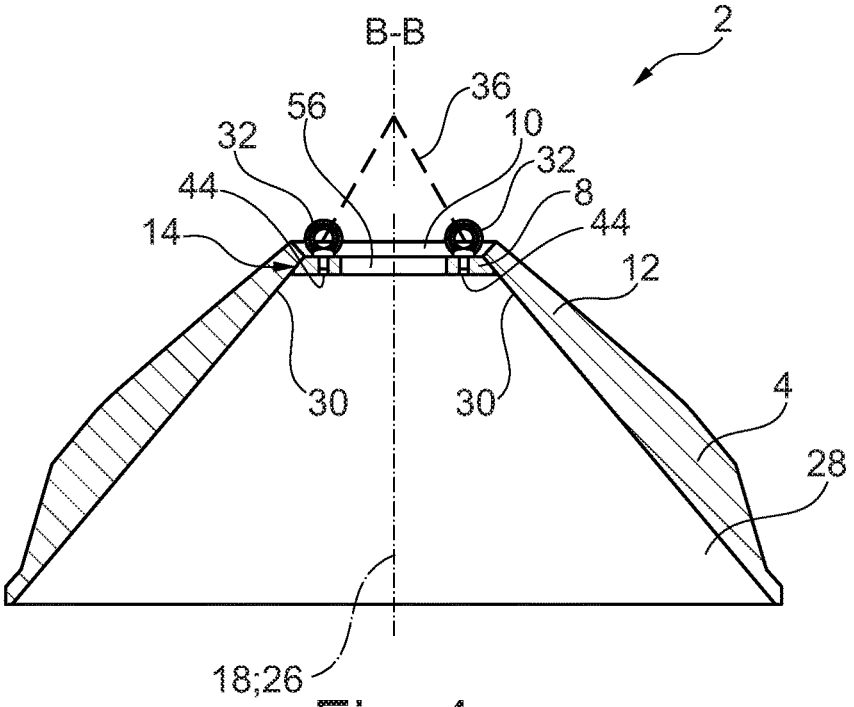
FIG. 4 the apparatus of FIG. 1 in a second orientation for operation in a sectional view according to section B-B of FIG. 5.
Figure 5:
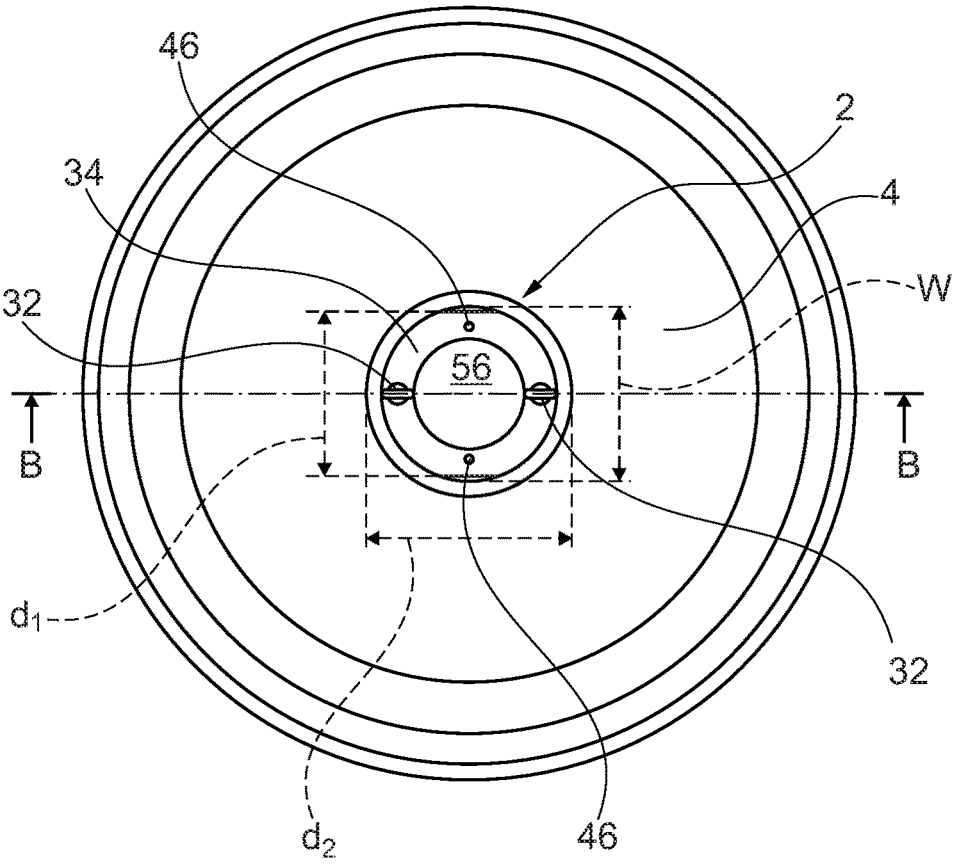
FIG. 5 the apparatus of FIG. 4 in a top view.

Then, the plate-shaped lifting member 8 may be rotated, opposite to the rotating direction 20, about the rotational axis 22 until, in the view direction parallel to the first central axis 26 of the crushing mantle 4, the clearance width w2 of the plate-shaped lifting member 8 in the second direction is larger again than the clearance width w of the opening 10 in the top region 12 of the crushing mantle 4, preferably corresponds to the second dimension d2 (see FIGS. 4 and 5). Thus, outer regions of the upper surface of the lifting member 8 provided in the second direction form the support surfaces 14 and come into contact from below with inner wall sections 30 of the internal cavity 28 at the top region 12 of the crushing mantle 4, thereby attaching the plate-shaped lifting member 8 to the wall sections 30 of the internal cavity 28 surrounding or delimiting the opening 10 in the top region 12 of the crushing mantle 4.

It is proposed that the inclination of the support surfaces 14 corresponds to the inclination of the cone shaped surface 30 of the internal cavity 28. This has the advantage that the support surfaces 14 can rest with their full surface on the cone-shaped inner wall surface 30 of the mantle head 12.

Finally, with the lifting member 8 attached to the crushing mantle 4, the plate-shaped lifting member 8 may be lifted in a direction opposite to view direction 24 and parallel to the first axis 26 of the crushing mantle 4, thereby also lifting the crushing mantle 4 attached thereto. To this end, it is proposed that respective attachment members 32 are provided or removably attached to the plate-shaped lifting member 8, preferably to a top surface 34 of the lifting member 8. The attachment members 32 may be in the form of hooks or eyelets or the like. The lifting member 8 can be lifted, for instance, by attaching a suspension assembly 36 to the attachment members 32. The suspension assembly 36 may be in the form of a hoist, a crane, a hydraulic lifting device or the like (see FIG. 6).

Figure 6:
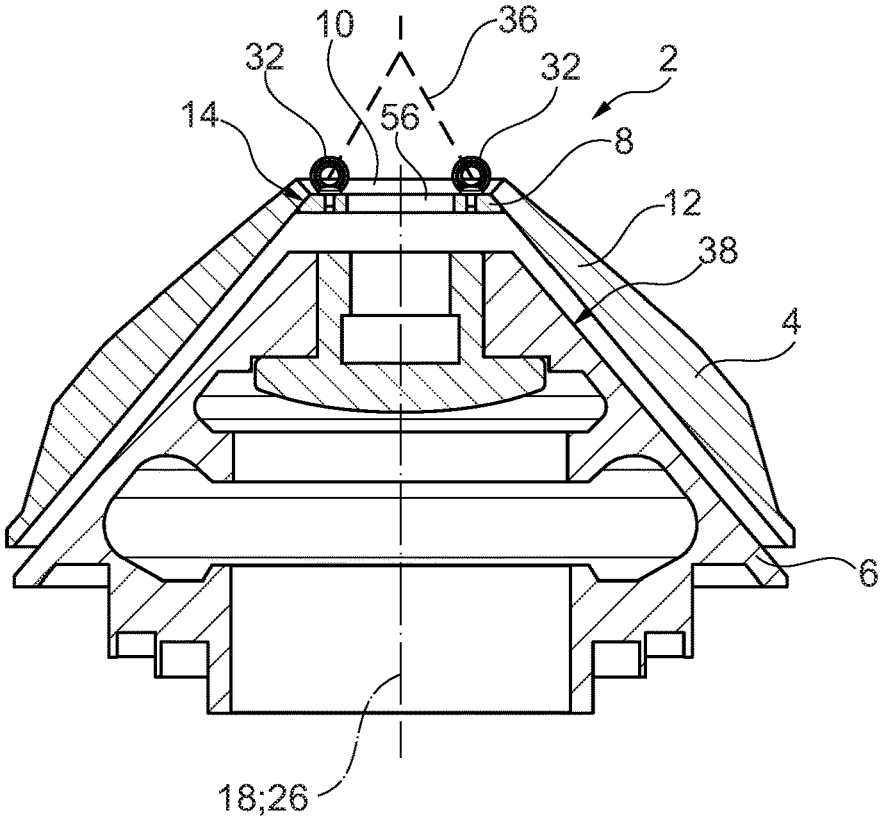
FIG. 6 the apparatus of FIG. 4 during operation of the apparatus in a sectional view.

By lifting the plate-shaped lifting member 8 together with the crushing mantle 4 temporarily attached thereto, a worn-out crushing mantle 4 may be lifted from the carrier element 6 of the crusher and/or a new or refurbished crushing mantle 4 may be placed onto the carrier element 6 of the crusher (see FIG. 6). In the case of a cone crusher, the carrier element 6 is a carrier cone. In the case of a gyratory crusher, the carrier element 6 has more of a hollow-cylindrical form. However, in both cases, the carrier elements 6 have an essentially cone shaped top surface 38, on which the crushing mantle 4 may be placed and attached to. Correspondingly, a bottom surface of the top or head 12 of the crushing mantle 4 facing towards the internal cavity 28, usually also has an essentially cone shaped form, no matter whether the crushing mantle 4 is intended for use in a cone crusher or a gyratory crusher.

Figure 7:
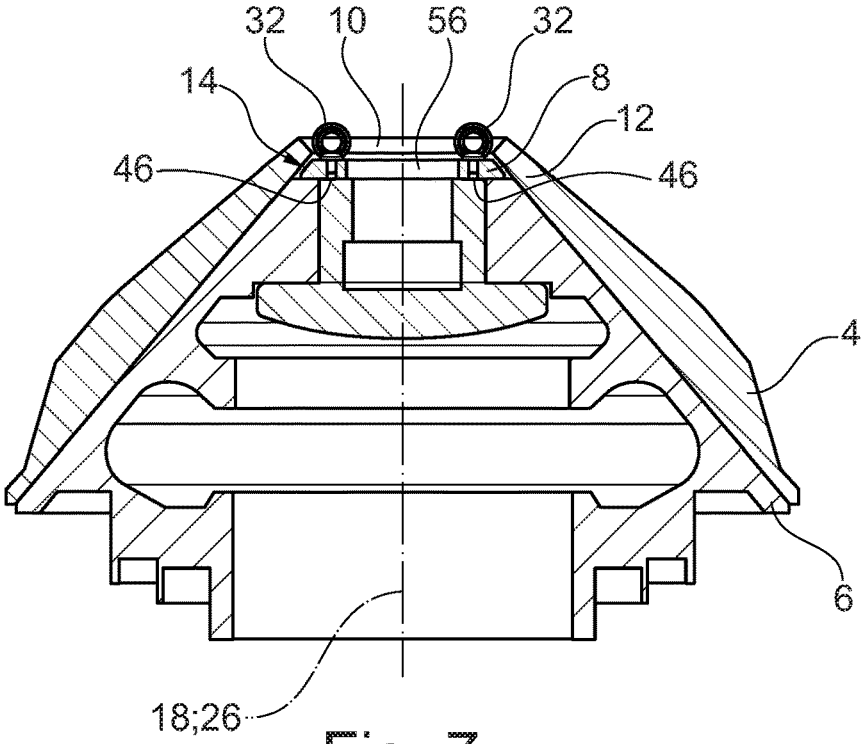
FIG. 7 the apparatus of FIG. 6 with a removed suspension assembly.

According to the disclosure it is particularly proposed that the plate-shaped lifting member 8 is attached to a new or renewed crushing mantle 4 as described above and shown in FIGS. 4 and 5. Then, the crushing mantle 4 is placed onto the respective carrier element 6 of the crusher and mounted thereto (see FIGS. 6 and 7). The insertion of the lifting element 8 through the preferably circular opening 10 in the head region 12 of the crushing mantle 4 is only possible when there is enough free space in the internal cavity 28 of the crushing mantle 4 and the mantle head 12, respectively. For passing through the opening 10, the lifting member 8 is oriented almost vertically—or at least in the given angle in respect to a top plane of the mantle head 12 (see FIGS. 2 and 3). Once the lifting member 8 is positioned inside the internal cavity 28 of the crushing mantle 4, it is oriented horizontally again—or almost parallel in respect to the top plane of the mantle head 12 (see FIGS. 4 and 5). In this situation, preferably, the first central axis 26 of the crushing mantle 4 and the second central axis 18 of the plate-shaped lifting member 8 are congruent or run essentially parallel to each other.

Figure 8:
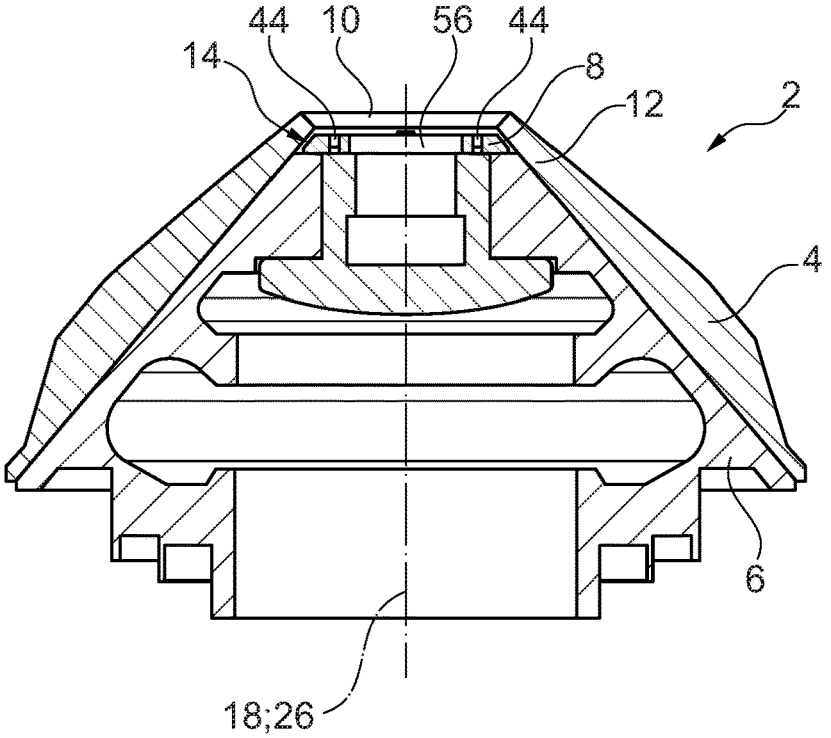
FIG. 8 the apparatus of FIG. 7 with removed attachment members and secured to a head region of a carrier element of a cone crusher or gyratory crusher.
Figure 9:
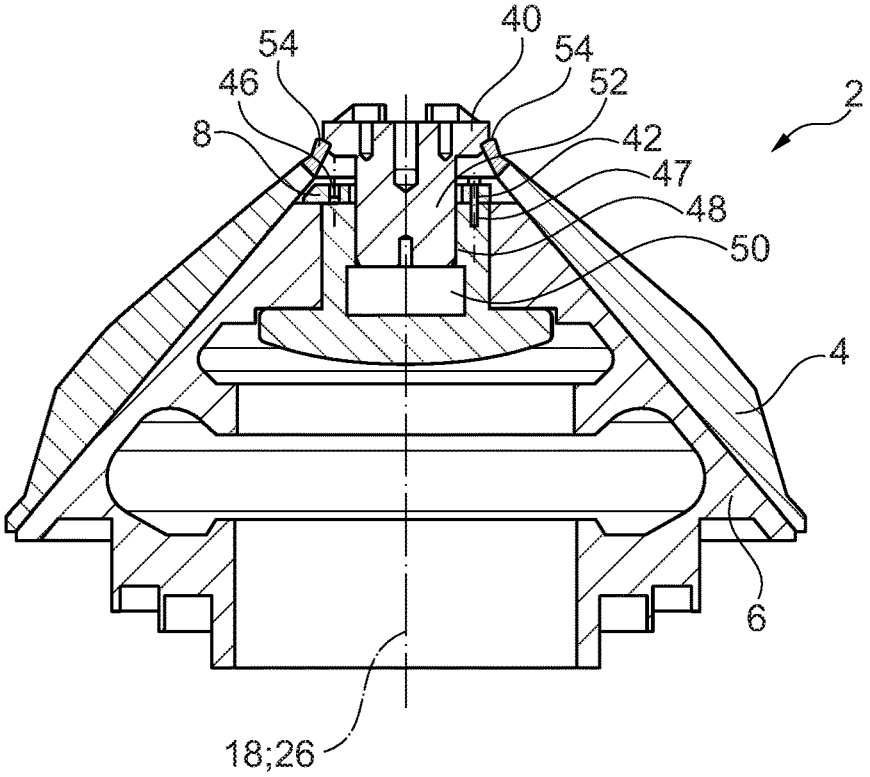
FIG. 9 the apparatus of FIG. 8 with a protective cover provided on a head region of a crushing mantle of the cone or gyratory crusher.

The attachment members 32 may be mounted to the lifting member 8 before or after its insertion into the internal cavity 28. For instance, the attachment members 32 are attached to attachment means 44 provided in the top surface 34 of the lifting member 8. In particular, it is proposed that the attachment members 32 are screwed into the threaded holes constituting the attachment means 44 (see FIG. 1). The crushing mantle 4 may be suspended on the attachment members 32 and lifted into the crusher onto the carrier element 6 (see FIG. 6). Once the crushing mantle 4 sits on the carrier element 6 (see FIG. 7), the attachment members 32 might be removed (see FIG. 8) and the plate-shaped lifting member 8 is secured in the internal cavity 28. In particular, it is proposed that the lifting member 8 is secured to the head region 12 of the crushing mantle 4 or—as shown in FIG. 9—to the carrier element 6. The lifting member 8 remains secured in the internal cavity 28 until the crushing mantle 4 is to be exchanged again, for instance because it is worn out from use.

After having placed the crushing mantle 4 onto the carrier element 6 by means of the lifting member 8, the attachment members 32 may be removed from the lifting member 8 and the crushing mantle 4 fastened to the carrier element 6 by means of one or more fastening means. In the embodiment shown in FIG. 9, the fastening means comprise a central head bolt 40. Its function is to clamp the mantle 4 to the carrier element 6. The head bolt 40 covers the plate-shaped lifting member 8 during the intended use of the crusher. Additionally, a protective cover (not shown in the figures) may be attached to the head bolt 40 or the crushing mantle 4 providing for additional protection of the mantle head 12 and/or the lifting member 8 from wear.

The lifting member 8 may be secured to the carrier element 6 by means of one or more securing screws 42. The securing screws 42 may be screwed into threaded holes 47 in the carrier element 6 which align with through holes 46 provided in the lifting member 8.

The fastening member 40 is attached to the carrier element 6. In the embodiment of FIG. 9, it has the form of the central head bolt and is attached to the carrier element 6. Attachment of the central head bolt 40 may be achieved in various ways. In the embodiment of FIG. 9, the central head bolt 40 is attached to the carrier element 6 by means of a threaded connection 48. To this end, the head region of the carrier element 6 has a central hole 50 symmetrically provided in respect to its central axis, corresponding to central axis 26 of the crushing mantle 4, when attached to the carrier element 6. At least part of the central hole 50 is provided with an internal thread corresponding to an external thread provided on a rod-shaped section 52 of the central head bolt 40. A so-called torch ring 54 may be provided between the central head bolt 40 and a top surface of the crushing mantle 4 delimiting the opening 10 provided in the head region 12 of the crushing mantle 4 (see FIG. 9). When detaching a worn crushing mantle 4 from the carrier element 6, the torch ring 54 is cut, e.g. with a blow torch, prior to unscrewing the head bolt 40. That releases the very strong connection between the parts.

It is further proposed that the plate-shaped lifting member 8 is provided with a central through hole 56 surrounding the second central axis 18 of the lifting member 8. This central through hole 56 may be used for inserting part of a protective cover 40, e.g. the rod-shaped part 52, and fixing it to the carrier element 6.

In contrast to what is shown in the figures, the plate-shaped lifting member 8 could also have a first dimension d1 significantly smaller than the second dimension d2 so the lifting member 8 has more of a bar shape than a plate shape. In that case, the central opening 56 could be omitted.

Figure 10:
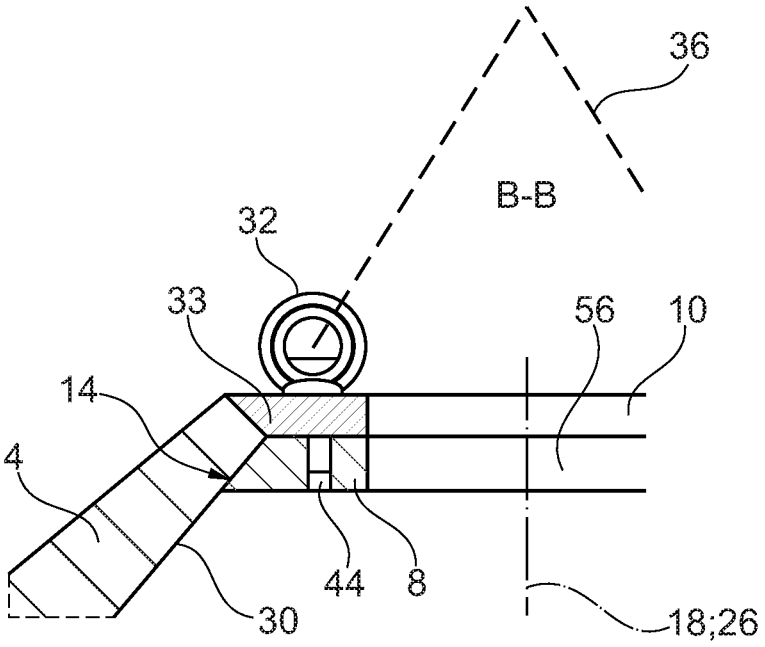
FIG. 10 a detail taken from FIG. 4.

FIG. 10 shows a further embodiment, where at least one of the attachment members 32 comprises a wedge shaped part 33. The wedge shaped part 33 may be designed separately from the attachment members 32 or form an integral part therewith. A separate wedge shaped part 33 may be clamped between the attachment member 32 and the plate-like lifting member 8, for instance by screwing the attachment member 32 into the threaded hole 44 in the top surface 34 of the lifting member 8, thereby clamping a top region 12 of the crushing mantle 4 surrounding the opening 10 between the support surface 14 of the lifting member 8 and the wedge shaped part 33. This allows a reliable and safe temporary fixation of the plate-shaped lifting member 8 to the crushing mantle 4.

Figure 11:
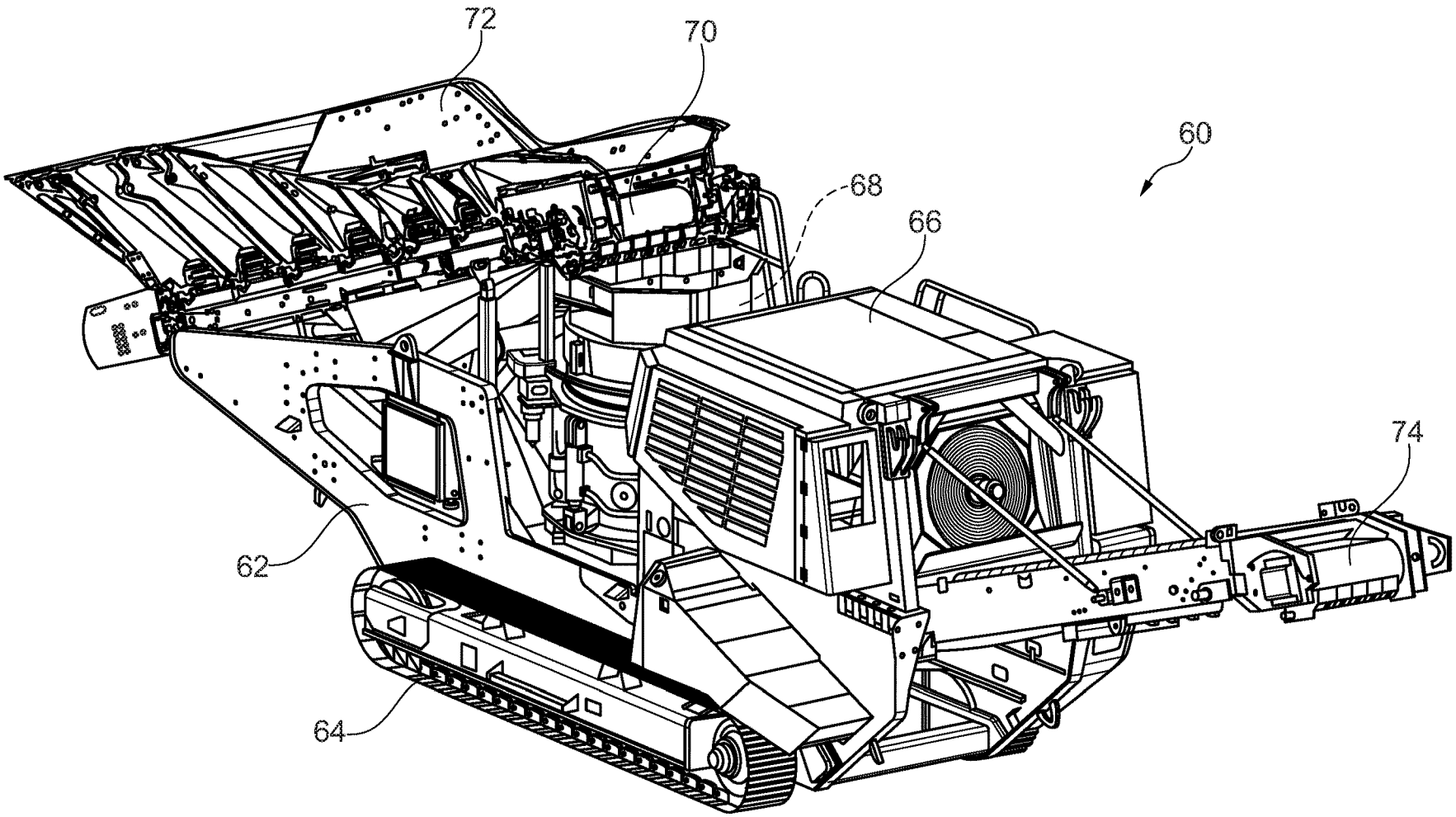
FIG. 11 a mobile cone or gyratory crusher for reducing the size of fed mineral material according to the present invention.

FIG. 11 shows a schematic view on a mobile cone or gyratory crusher according to the present invention, designated in its entirety with reference sign 60. The crusher comprises a frame or chassis 62 to which wheels or chains 64 are attached in order to move the crusher 60 onto a transportation vehicle, e.g. a train wagon or a low loader, or to its intended site of operation, or to place the crusher 60 to its intended position and orientation in the site of operation. The crusher 60 is provided with a motor 66, which is preferably an internal combustion engine but could also be an electric motor powered by appropriate rechargeable batteries.

The crusher 60 serves for reducing the size of fed mineral material like stone, rock, concrete or the like. In its inside and therefore not visible in FIG. 11, the crusher 60 comprises a crushing mantle 4 releasably attached to a carrier element 6 rotatable about a working axis. The crushing mantle 4 makes part of a crushing chamber 68, located inside the crusher 60. The mineral material is fed to the crushing chamber 68 by means of a conveyor belt 70. Instead of the conveyor belt 70, the material could also be fed to the crushing chamber 68 by means of a vibratory feeder or the like. The mineral material is received by means of a hopper 72 and placed on the conveyor belt 70. The crushed material may be discarded from the crushing chamber 68 through a further conveyor belt 74.

For lifting the crushing mantle 4 of the crusher 60 from the carrier element 6 and replacing it by another crushing mantle 4, an apparatus 2 according to the present invention and comprising the plate-shaped lifting member 8 is used. Before the crushing mantle 4 may be lifted, it may be necessary to first remove one or more components of the crusher 60, for instance the conveyor belt 70 and/or the hopper 72, from above the crushing chamber 68. It is also conceivable to first extract the carrier element 6 with the crushing mantle 4 attached thereto from the crusher 60 and to perform replacement of a worn mantle 4 with a new one outside the crusher 60.

Figure 12:
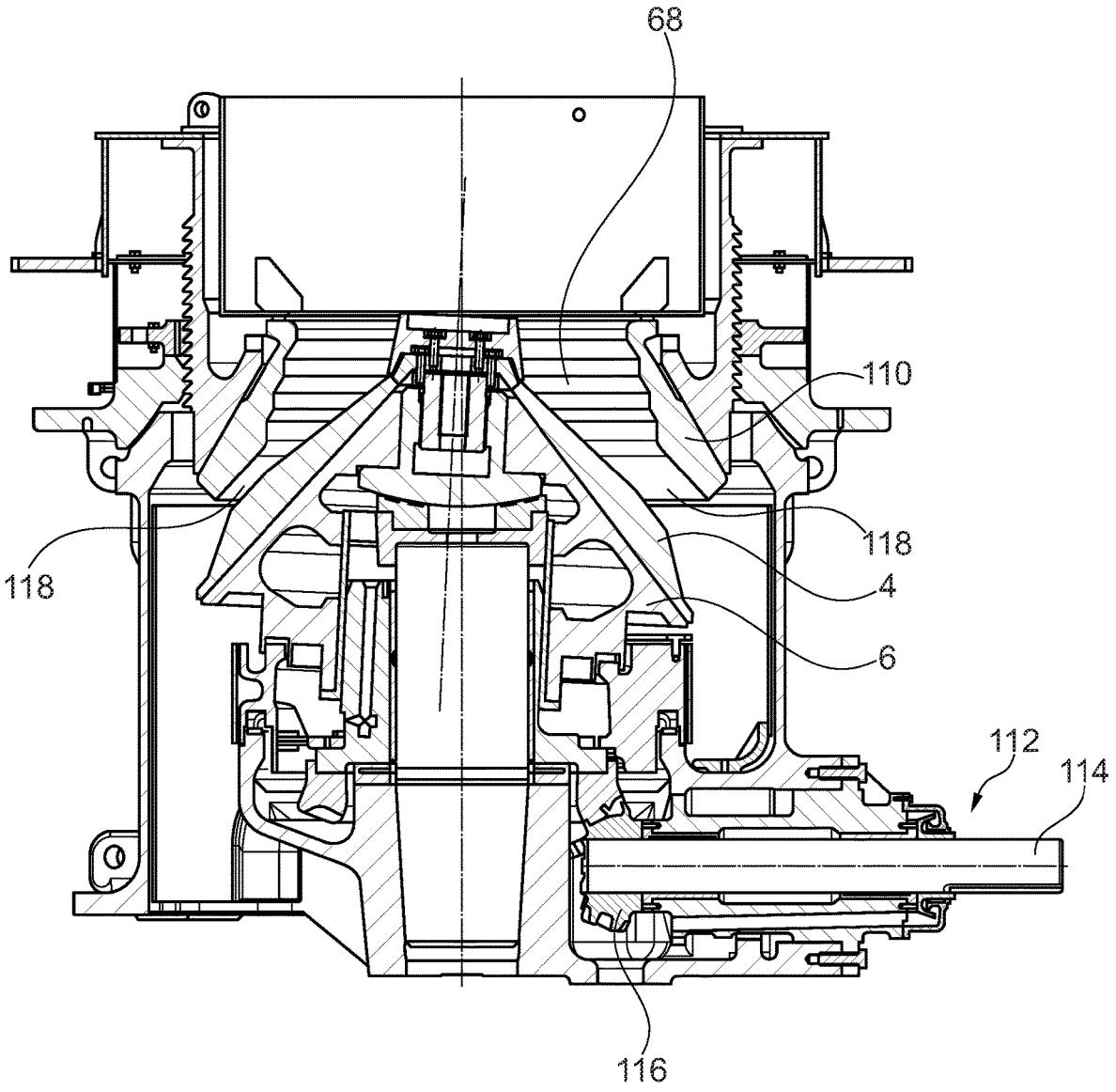
FIG. 12 a crushing chamber of a cone crusher according to the present invention.

A part of a cone crusher 60—as an example for a crusher according to the present invention—is shown in detail in FIG. 12. During operation of the cone crusher 60, the crushing mantle 4 moves eccentrically in respect to a fixed crushing ring 110. The carrier element 6 is set into a tumbling or oscillating motion by a driving mechanism 112 of the cone crusher 60. In FIG. 12 the driving mechanism 112 comprises a drive shaft 114 and a bevel gear 116. However, other embodiments are conceivable, too. The drive shaft 114 is driven by a motor (not shown). The dimensions of a crushing gap 118 (or chamber 68) between the fixed crushing ring 110 and the rotating crushing mantle 4 in a certain point along the circumferential direction change continuously. In the crushing chamber 68, the material to be crushed is crushed by squeezing and compressing until it can leave the cone crusher 60 as crushed material through the crushing gap 118. With other words, the carrier cone 6 with the crushing mantle 4 is entrained in an oscillating or gyrating motion about a rotational axis, wherein the crushing gap 118 between the crushing mantle 4 and the outer crushing ring 110 varies at each point during the cycle.

The smallest crusher gap 118 occurring during the cycle is called the closed side setting (CSS) of the cone crusher 60, and the difference between the maximum and the minimum of the gap 118 is called the stroke of the crusher 60. By the crusher setting and the crusher stroke, as well as the operating speed of the crusher 60, it is possible, among other things, to influence the grain size distribution of the crushed material and the production capacity of the crusher 60.

The outer crushing ring 110 as well as the inner crushing mantle 4 are used as wearing parts during operation of the cone crusher 60 and, therefore, have to be replaced from time to time. The apparatus 2 according to the invention is provided for easy and safe lifting of a crushing mantle 4 in order to lift it off the carrier element 6 or to place it onto the carrier element 6. The apparatus 2 is used in a crusher 60 according to the invention.

Figure 13:
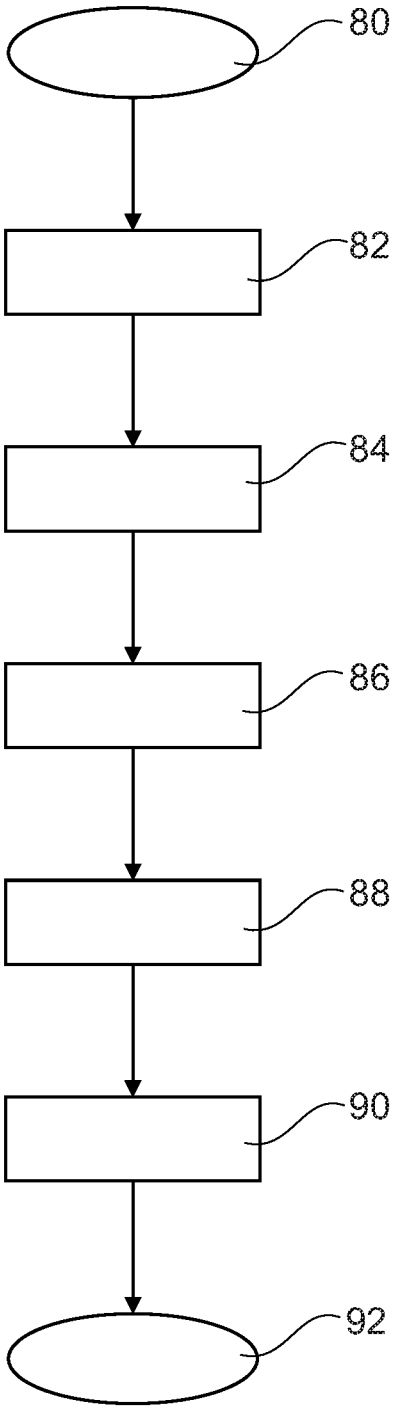
FIG. 13 a flow chart of a method for lifting a crushing mantle of a cone or gyratory crusher according to the present invention.

FIG. 13 shows a flowchart of a method for lifting the crushing mantle 4 of a cone or gyratory crusher 60 according to the present invention. The method starts in a functional block 80. Then, in a functional block 82, an apparatus 2 according to the present invention comprising the plate-shaped lifting member 8 is provided. In functional block 84, the plate-shaped lifting member 8 of the apparatus 2 is rotated, in a rotating direction 20, about a rotational axis 22 extending essentially parallel to the first direction and perpendicular to the second central axis 18 of the plate-shaped lifting member 8 until, in a view direction 24 onto the plate-shaped lifting member 8 parallel to the first central axis 26 of the crushing mantle 4, the clearance width w2 of the plate-shaped lifting member 8 in the second direction is smaller than the clearance width w of the opening 10 in the top region 12 of the crushing mantle 4.

Then, in a functional block 86, the plate-shaped lifting member 8 is inserted through the opening 10 in the top region 12 of the crushing mantle 4 into an internal cavity 28 of the crushing mantle 4. In a functional block 88, the plate-shaped lifting member 8 is rotated, opposite to the rotating direction 20, about the rotational axis 22 until, in the view direction 24 parallel to the first central axis 26 of the crushing mantle 4, the clearance width w2 of the plate-shaped lifting member 8 in the second direction is larger again than the clearance width w of the opening 10 in the top region 12 of the crushing mantle 4, thereby attaching the plate-shaped lifting member 8 to a wall 30 of the internal cavity 28 of the crushing mantle 4. Finally, in functional block 90, the plate-shaped lifting member 8 is lifted in a direction parallel to the first axis 26 of the crushing mantle 4, thereby also lifting the crushing mantle 4 attached thereto. In functional block 92, the method is ended.

By means of the plate-shaped lifting member 8, the crushing mantle 4 may be lifted from the carrier element 6 of the cone or gyratory crusher 60 for removal therefrom or placed on the carrier element 6 of the cone or gyratory crusher 60 for attachment thereto.

Further Disclosure

The following further disclosure is in the form of clauses which are representative of additional claims that Applicant may pursue:

Clause 1. Apparatus (2) for lifting a crushing mantle (4) of a cone or gyratory crusher, the crushing mantle (4) having a first central axis (26) and an opening (10) with a clearance width (w) in its top region (12) surrounding the first central axis (26), and the apparatus (2) comprising a plate-shaped lifting member (8) having a second central axis (18) and adapted to be attached to the top region (12) of the crushing mantle (4), wherein the first central axis (26) coincides with the second central axis (18) when the plate-shaped lifting member (8) is attached to the crushing mantle (4);

the plate-shaped lifting member (8) comprising at least one attachment member (32) adapted to be attached to a suspension assembly (36), in order to lift the plate-shaped lifting member (8) together with the crushing mantle (4) attached thereto, characterized in that the plate-shaped lifting member (8) has a first dimension (d1) in a first direction being smaller than the clearance width (w) of the opening (10) in the top region (12) of the crushing mantle (4); and the plate-shaped lifting member (8) has a second dimension (d2) in a second direction being larger than the clearance width (w) of the opening (10) in the top region (12) of the crushing mantle (4);

wherein the first direction and the second direction run obliquely in respect to each other.

Clause 2. Apparatus (2) according to clause 1, wherein an outer section of a top surface of the plate-shaped lifting member (8) constitutes a support surface (14), with which, during lifting the plate-shaped lifting member (8) together with the crushing mantle (4) attached thereto, the plate-shaped lifting member (8) rests on an internal surface (30) of the crushing mantle (4) surrounding the opening (10) provided in the top region (12) of the crushing mantle (4).

Clause 3. Apparatus (2) according to clause 2, wherein the support surface (14) is provided on that part of the top surface of the plate-shaped lifting member (8), where the plate-shaped lifting member (8) has the second dimension (d2).

Clause 4. Apparatus (2) according to clause 2 or 3, wherein in a sectional view comprising the second central axis (18) of the plate-shaped lifting member (8), the support surface (14) has an inclination, resulting in a support surface (14) having the form of one or more cone wedges.

Clause 5. Apparatus (2) according to clause 4, wherein the inclination of the support surface (14) corresponds to an inclination of a cone shaped wall (30) of an internal cavity (28) of the crushing mantle (4).

Clause 6. Apparatus (2) according to one of the preceding clauses, wherein a top surface (34) of the plate-shaped lifting member (8) is provided with attachment means (44) for removably attaching at least one attachment member (32).

Clause 7. Apparatus (2) according to clause 6, wherein the attachment means (44) comprise at least one threaded hole for screwing at least one attachment member (32) therein.

Clause 8. Apparatus (2) according to one of the preceding clauses, wherein the plate-shaped lifting member (8) is provided with a central through hole (56) surrounding the second central axis (18).

Clause 9. Apparatus (2) according to one of the preceding clauses, wherein the plate-shaped lifting member (8) is provided with securing means (46) for releasably securing the plate-shaped lifting member (8) to the carrier element (6).

Clause 10. Apparatus (2) according to clause 9, wherein the securing means (46) comprise at least one through hole for securing the plate-shaped lifting member (8) to the carrier element (6) by means of at least one securing screw (42).

Clause 11. Cone crusher or gyratory crusher for reducing the size of fed mineral material like stone, rock, concrete or the like, the crusher comprising a crushing mantle (4) releasably attached to a carrier element (6) rotatable about a working axis, characterized in that the crusher further comprises an apparatus (2) for lifting the crushing mantle (4) of the crusher according to one of the preceding claims.

Clause 12. Crusher according to clause 11, wherein the crusher comprises fastening means (40) for fastening the crushing mantle (4) to the carrier element (6) once the crushing mantle (4) has been placed on the carrier element (6) and preferably, if at least one attachment member (32) has previously been attached to the plate-shaped lifting member (8), once the at least one attachment member (32) has been detached and removed from the plate-shaped lifting member (8).

Clause 13. Crusher according to clause 12, wherein part (52) of the fastening means (40) reaches through a through hole (56) provided in the plate-shaped lifting member (8) and is secured to a head region of the carrier element (6).

Clause 14. Method for lifting a crushing mantle (4) of a cone crusher or gyratory crusher, comprising the steps of:

providing an apparatus (2) according to one of the claims 1 to 10, rotating, in a rotating direction (20), the plate-shaped lifting member (8) of the apparatus (2) about a rotational axis (22) extending essentially parallel to the first direction and perpendicular to the second central axis (18) of the plate-shaped lifting member (8) until, in a view direction (24) onto the plate-shaped lifting member (8) parallel to the first central axis (26) of the crushing mantle (4), the clearance width (w2) of the plate-shaped lifting member (8) in the second direction is smaller than the clearance width (w) of the opening (10) in the top region (12) of the crushing mantle (4);

inserting the plate-shaped lifting member (8) through the opening (10) in the top region (12) of the crushing mantle (4) into an internal cavity (28) of the crushing mantle (4);

rotating, opposite to the rotating direction (20), the plate-shaped lifting member (8) about the rotational axis (22) until, in the view direction (24) parallel to the first central axis (26) of the crushing mantle (4), the clearance width (w2) of the plate-shaped lifting member (8) in the second direction is larger again than the clearance width (w) of the opening (10) in the top region (12) of the crushing mantle (4), thereby attaching the plate-shaped lifting member (8) to a wall (30) of the internal cavity (28) of the crushing mantle (4); and lifting the plate-shaped lifting member (8) in a direction parallel to the first axis (26) of the crushing mantle (4), thereby also lifting the crushing mantle (4) attached thereto.

Clause 15. Method according to clause 14, wherein by means of the plate-shaped lifting member (8), the crushing mantle (4) is lifted from a carrier element (6) of the cone crusher or gyratory crusher for removal therefrom or placed on the carrier element (6) of the cone crusher or gyratory crusher for attachment thereto.

What is claimed is:

1. A lifting apparatus, comprising:

a crushing mantle for a cone crusher or gyratory crusher, the crushing mantle having a first central axis and an opening with a clearance width in a top region of the crushing mantle surrounding the first central axis;

a plate-shaped lifting member having a second central axis and configured to be attached to the top region of the crushing mantle, wherein the first central axis coincides with the second central axis when the plate-shaped lifting member is attached to the crushing mantle;

the plate-shaped lifting member including at least one attachment member configured to be attached to a suspension assembly in order to lift the plate-shaped lifting member together with the crushing mantle attached to the plate-shaped lifting member;

wherein the plate-shaped lifting member has a first dimension in a first direction being smaller than the clearance width of the opening in the top region of the crushing mantle;

wherein the plate-shaped lifting member has a second dimension in a second direction being larger than the clearance width of the opening in the top region of the crushing mantle; and wherein the first direction and the second direction run obliquely in respect to each other.

2. The apparatus according to claim 1, wherein an outer section of a top surface of the plate-shaped lifting member includes a support surface configured such that during lifting of the plate-shaped lifting member together with the crushing mantle attached thereto, the plate-shaped lifting member rests on an internal surface of the crushing mantle surrounding the opening provided in the top region of the crushing mantle.

3. The apparatus according to claim 2, wherein the support surface is provided on a part of the top surface of the plate-shaped lifting member where the plate-shaped lifting member has the second dimension.

4. The apparatus according to claim 3, wherein in a sectional view comprising the second central axis of the plate-shaped lifting member, the support surface has an inclination resulting in the support surface having a form of one or more cone wedges.

5. The apparatus according to claim 2, wherein in a sectional view comprising the second central axis of the plate-shaped lifting member, the support surface has an inclination resulting in the support surface having a form of one or more cone wedges.

6. The apparatus according to claim 5, wherein the inclination of the support surface corresponds to an inclination of a cone shaped wall of an internal cavity of the crushing mantle.

7. The apparatus according to claim 1, wherein a top surface of the plate-shaped lifting member is provided with attachment means for removably attaching at least one attachment member.

8. The apparatus according to claim 7, wherein the attachment means comprises at least one threaded hole for screwing the at least one attachment member therein.

9. The apparatus according to claim 1, wherein the plate-shaped lifting member includes a central through hole surrounding the second central axis.

10. The apparatus according to claim 1, wherein the plate-shaped lifting member is provided with securing means for releasably securing the plate-shaped lifting member to a carrier element of the cone crusher or the gyratory crusher.

11. The apparatus according to claim 10, wherein the securing means comprises at least one through hole for securing the plate-shaped lifting member to the carrier element by means of at least one securing screw.

12. A cone crusher or gyratory crusher for reducing the size of fed mineral material like stone, rock, concrete or the like, the crusher comprising:

a carrier element rotatable about a working axis;

a crushing mantle releasably attached to the carrier element, the crushing mantle having a first central axis and an opening with a clearance width in a top region of the crushing mantle surrounding the first central axis;

a plate-shaped lifting member having a second central axis and configured to be attached to the top region of the crushing mantle, wherein the first central axis coincides with the second central axis when the plate-shaped lifting member is attached to the crushing mantle;

the plate-shaped lifting member including at least one attachment member configured to be attached to a suspension assembly in order to lift the plate-shaped lifting member together with the crushing mantle attached to the plate-shaped lifting member;

wherein the plate-shaped lifting member has a first dimension in a first direction being smaller than the clearance width of the opening in the top region of the crushing mantle;

wherein the plate-shaped lifting member has a second dimension in a second direction being larger than the clearance width of the opening in the top region of the crushing mantle; and wherein the first direction and the second direction run obliquely in respect to each other.

13. The crusher according to claim 12, wherein the crusher comprises at least one fastener configured to fasten the crushing mantle to the carrier element once the crushing mantle has been placed on the carrier element.

14. The crusher according to claim 13, wherein part of the at least one fastener reaches through a through hole provided in the plate-shaped lifting member and is secured to a head region of the carrier element.

15. A method of lifting a crushing mantle of a cone crusher or gyratory crusher, the crushing mantle having a first central axis and an opening with a clearance width in a top region of the crushing mantle surrounding the first central axis, the method comprising the steps of:

providing a lifting apparatus including a plate-shaped lifting member having a second central axis and configured to be attached to the top region of the crushing mantle, wherein the first central axis coincides with the second central axis when the plate-shaped lifting member is attached to the crushing mantle, wherein the plate-shaped lifting member has a first dimension in a first direction being smaller than the clearance width of the opening in the top region of the crushing mantle, wherein the plate-shaped lifting member has a second dimension in a second direction being larger than the clearance width of the opening in the top region of the crushing mantle, and wherein the first direction and the second direction run obliquely in respect to each other;

rotating, in a rotating direction, the plate-shaped lifting member of the lifting apparatus about a rotational axis extending essentially parallel to the first direction and perpendicular to the second central axis of the plate-shaped lifting member until, in a view direction onto the plate-shaped lifting member parallel to the first central axis of the crushing mantle, a clearance width of the plate-shaped lifting member in the second direction is smaller than the clearance width of the opening in the top region of the crushing mantle;

inserting the plate-shaped lifting member through the opening in the top region of the crushing mantle into an internal cavity of the crushing mantle;

rotating, opposite to the rotating direction, the plate-shaped lifting member about the rotational axis until, in the view direction parallel to the first central axis of the crushing mantle, the clearance width of the plate-shaped lifting member in the second direction is larger again than the clearance width of the opening in the top region of the crushing mantle, and engaging the plate-shaped lifting member with a wall of the internal cavity of the crushing mantle; and lifting the plate-shaped lifting member in a direction parallel to the first axis of the crushing mantle, thereby also lifting the crushing mantle attached thereto.

16. The method according to claim 15, wherein by means of the plate-shaped lifting member, the crushing mantle is lifted from a carrier element of the cone crusher or gyratory crusher for removal therefrom or placed on the carrier element of the cone crusher or gyratory crusher for attachment thereto.

* * * * *